United States Patent [19]

Dunn

[11] Patent Number: 4,711,414

[45] Date of Patent: Dec. 8, 1987

[54] PROJECTILE WITH INTEGRATED PROPULSION SYSTEM

[75] Inventor: Michael J. Dunn, Auburn, Wash.

[73] Assignee: The Boeing Company, Seattle, Wash.

[21] Appl. No.: 846,023

[22] Filed: Mar. 31, 1986

[51] Int. Cl.[4] ..... F42B 15/033

[52] U.S. Cl. ..... 244/3.22; 239/265.27

[58] Field of Search ..... 244/3.22, 169; 239/265.19, 265.23, 265.25, 265.27

[56] References Cited

U.S. PATENT DOCUMENTS

| | | | |
|---|---|---|---|
| 3,062,483 | 11/1962 | Davidson | 244/42 |
| 3,066,894 | 12/1962 | Davidson | 244/76 |
| 3,148,848 | 9/1964 | Price | 244/23 |
| 3,237,892 | 3/1966 | Elliott et al. | 244/73 |
| 3,258,916 | 7/1966 | Lehmann | 60/35.55 |
| 3,362,660 | 1/1968 | Tyler | 244/75 |
| 3,367,581 | 2/1968 | Kizilos et al. | 239/520 |
| 3,669,386 | 6/1972 | Jacobs et al. | 244/52 |
| 3,670,994 | 6/1972 | Kizilos | 244/42 |
| 3,802,190 | 4/1974 | Kaufmann | 244/3.22 |
| 4,236,684 | 12/1980 | Berrier | 244/52 |
| 4,288,051 | 9/1981 | Goschel | 244/164 |
| 4,407,469 | 10/1983 | Fox | 244/169 |
| 4,413,795 | 11/1983 | Ryan | 244/3.22 |
| 4,550,888 | 11/1985 | Douglass et al. | 244/3.22 |

*Primary Examiner*—Charles T. Jordan

*Attorney, Agent, or Firm*—Christensen, O'Connor, Johnson & Kindness

[57] ABSTRACT

A projectile having an efficient integrated propulsion system such that the projectile can guide itself to a target. The projectile comprises a body in which eight supersonic nozzles are positioned. The nozzles are arranged such that each nozzle can provide a reaction force having nonzero components along first and second axes that are fixed with respect to the body and orthogonal to one another. The nozzles are arranged in first and second groups of four nozzles each, the first and second groups being spaced from one another along a third axis orthogonal to the first and second axes. The third axis is generally parallel to the course of the projectile towards the target. The nozzles in each group are arranged such that for each direction along each of the first and second axes, two nozzles of the group can produce a reaction force having a nonzero component along that direction. Each nozzle preferably comprises a Prandtl-Meyer expansion nozzle that is lineraly elongated along the third axis.

13 Claims, 12 Drawing Figures

| MOVEMENT | NOZZLE | | | | | | | |
|---|---|---|---|---|---|---|---|---|
| | 21 | 22 | 23 | 24 | 31 | 32 | 33 | 34 |
| TRANSLATE +X | X | | X | | X | | X | |
| TRANSLATE -X | | X | | X | | X | | X |
| TRANSLATE +Y | | | X | X | | | X | X |
| TRANSLATE -Y | X | X | | | X | X | | |
| ROLL CLOCKWISE | | X | X | | | X | X | |
| ROLL COUNTERCLOCKWISE | X | | | X | X | | | X |
| PITCH CLOCKWISE | X | X | | | | | X | X |
| PITCH COUNTERCLOCKWISE | | | X | X | X | X | | |
| YAW CLOCKWISE | X | | X | | | X | | X |
| YAW COUNTERCLOCKWISE | | X | | X | X | | X | |

Fig. 3.
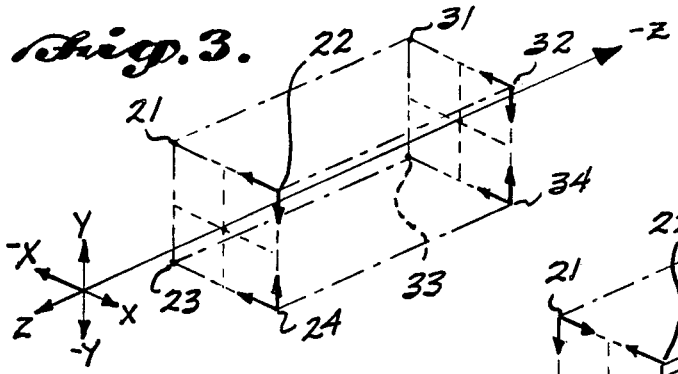
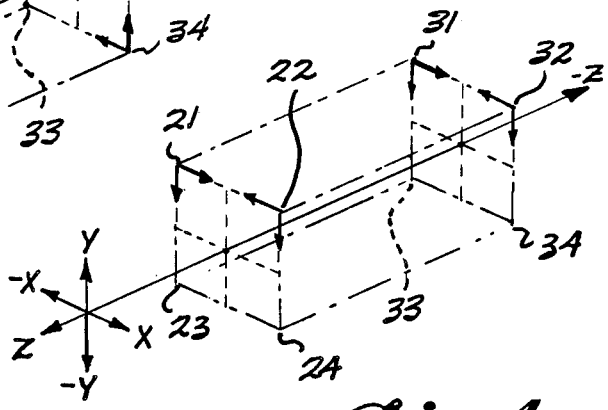
Fig. 4.
Fig. 5.
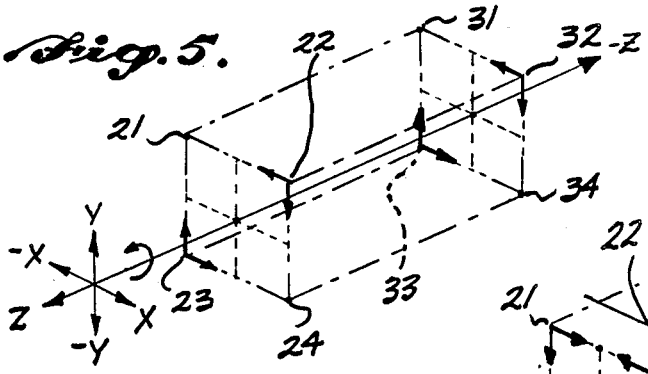
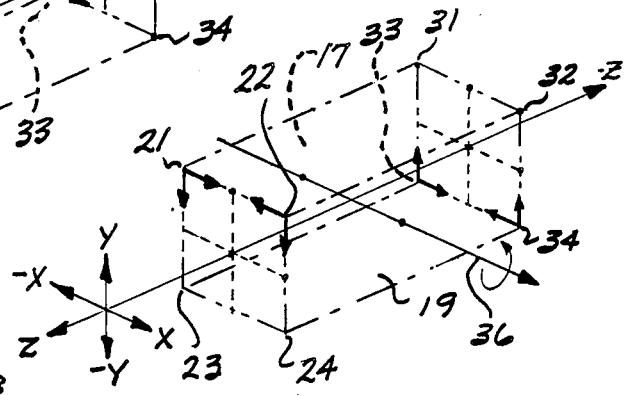
Fig. 6.
Fig. 7.
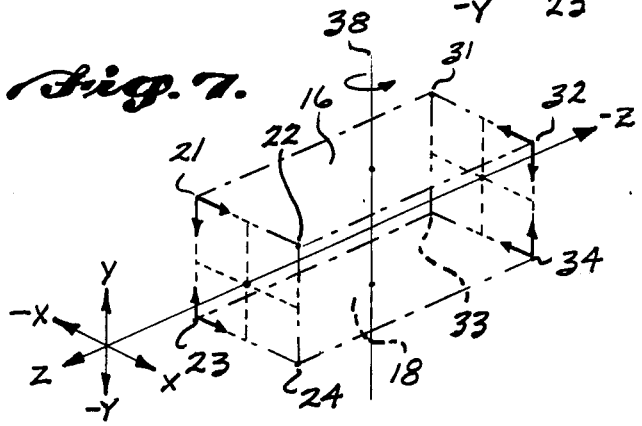

PROJECTILE WITH INTEGRATED PROPULSION SYSTEM

BACKGROUND OF THE INVENTION

The present invention is directed to a projectile that includes propulsion means for enabling the projectile to maneuver itself so as to hit a target. A principal obstacle to the practical implementation of such a projectile is the difficulty in designing a lightweight projectile that includes both the required avionics and a propulsion system capable of conducting fast response, high acceleration transverse maneuvers.

SUMMARY OF THE INVENTION

The present invention provides a projectile having an efficient integrated propulsion system. The projectile can be launched towards a target by separate booster means, and can then perform maneuvers in directions transverse to its course in order to guide itself to strike the target. The propulsion system of the projectile is constructed so as to minimize inert mass associated only with the propulsion system, to thereby decrease the mass and improve the maneuverability of the projectile.

The projectile comprises a body in which eight supersonic nozzles are positioned. The nozzles are arranged such that each nozzle can provide a reaction force having nonzero components along first and second axes that are fixed with respect to the body and orthogonal to one another. The nozzles are arranged in first and second groups of four nozzles each, the first and second groups being spaced from one another along a third axis orthogonal to the first and second axes. The third axis is generally parallel to the course of the projectile towards the target. The nozzles in each group are arranged such that for each direction along each of the first and second axes, two nozzles of the group can each produce a reaction force having a nonzero component along that direction. As a result, different nozzle combinations can be used to produce any desired rotational or lateral translational movement.

In a preferred aspect, the nozzles of each group are positioned at or near the four corners of a rectangle, such that two sides of the rectangle are parallel to the first axis and the other two sides of the rectangle are parallel to the second axis. Each nozzle includes a throat through which gas can escape in an initial flow direction that is principally inward along the second axis, and a reaction surface having a contour that extends from adjacent the throat inward along the second axis and outward along the first axis. Each nozzle preferably comprises a Prandtl-Meyer expansion nozzle that is linearly elongated along the third axis.

BRIEF DESCRIPTION OF THE DRAWINGS

FIG. 3 is a conceptual view illustrating translational movement along the X axis;

FIG. 4 is a conceptual view illustrating translational movement along the Y axis;

FIG. 5 is a conceptual view illustrating roll about the Z axis;

FIG. 6 is a conceptual view illustrating pitch rotation;

FIG. 7 is a conceptual view illustrating yaw rotation;

DETAILED DESCRIPTION OF THE INVENTION

Figures 1, 2:
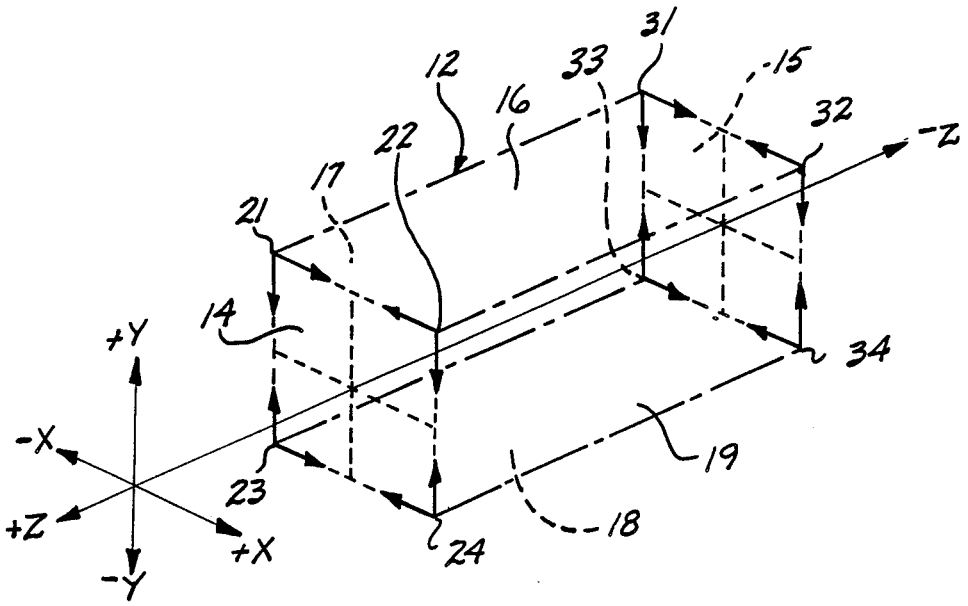
FIG. 1 is a conceptual view of the projectile of the present invention.
FIG. 2 is a table showing the nozzles that may be activated to produce different movements of the projectile.

FIG. 1 presents a conceptual view of the projectile of the present invention. The projectile comprises a body that is represented by regular parallelepiped 12, i.e., by a three-dimensional object having six rectangular faces. Parallelepiped 12 includes end faces 14 and 15 and side faces 16–19. In FIG. 1, an orthogonal coordinate system is utilized in which the Z axis is normal to end faces 14 and 15 and passes through the center points of the end faces, and in which the Y axis is parallel to side faces 17 and 19 and the X axis is parallel to side faces 16 and 18.

Eight nozzles are positioned in the body represented by parallelepiped 12. The nozzles comprise a first group of nozzles 21–24 at the corners of end face 14, and a second group of nozzles 31–34 at the corners of end face 15. Each nozzle is constructed such that when the nozzle is activated, gases escaping through the nozzle produce a reaction force on the projectile that has components along both the X and Y axes. The X and Y components of the reaction forces for each nozzle are illustrated by the small arrows extending from each nozzle. Thus nozzle 21, when activated, produces a reaction force having components in the +X and −Y directions. Nozzle 22, when activated, produces a reaction force having components in the −X and −Y directions, etc. Each nozzle at a given corner of one of the end faces produces a reaction force having components directed towards both of the two adjacent corners of that end face. The result is that, for each nozzle group, two nozzles are capable of producing a reaction force in each direction along each of the X and Y axes.

The projectile schematically represented in FIG. 1 is designed to be launched by separate booster means along a course towards a target or towards a rendezvous point with a target, such that the course of the projectile is generally along the Z axis. The purpose of nozzles 21–24 and 31–34 is to permit the projectile to maneuver in directions transverse to its course, such that the projectile can guide itself so as to score a direct hit on the target. FIGS. 2–7 illustrate the means by which selected activation of nozzles 21–24 and 31–34 may be used to cause any desired X and Y translational movement or any rotational movement of the projectile. In a preferred arrangement, valves or equivalent devices within the projectile direct flow to selected nozzles, such that four of the eight nozzles are active at any given time. FIG. 2 summarizes the groups of four nozzles that can be activated to produce the indicated translational and rotational movements, it being understood that composite movements (e.g., translation plus rotation) could be produced by activation of different nozzle numbers and combinations.

FIG. 3 illustrates that activation of nozzles 22, 24, 32 and 34 will produce translational movement in the −X direction. In a similar manner, activation of nozzles 21, 23, 31 and 33 will produce translational motion in the +X direction. FIG. 4 illustrates that activation of nozzles 21, 22, 31 and 32 will produce translational movement in −Y direction, while activation of nozzles 23, 24, 33 and 34 will produce translational motion in the +Y direction.

Referring to FIG. 5, roll of the projectile, i.e., rotation about the Z-axis, may be achieved by activation of nozzles 22, 23, 32 and 33. Examination of FIG. 5 will indicate that the generation of roll movement in the illustrated embodiment requires that for each nozzle, the net reaction force produced by the nozzle does not pass through the center line of the projectile, i.e., does not pass through the Z axis. In general, this condition can be realized either by adjusting the positions of the nozzles or the relative magnitudes of the forces produced by each nozzle in the X and Y directions. In FIG. 5, it is assumed that each of nozzles 21, 22, 31 and 32 produces a net reaction force that is directed such that the force vector from each nozzle passes through the Y-Z plane at a positive Y value, and that each of nozzles 23, 24, 33 and 34 produces a net reaction force that is directed such that the force vector from each nozzle passes through the Y-Z plane at a negative Y value. Activation of nozzles 22, 23, 32 and 33 will therefore result in the indicated clockwise roll of the projectile about the Z axis, as viewed looking along the Z axis in the +Z direction. Similarly, activation of nozzles 21, 24, 31 and 34 will produce a roll movement in the opposite direction, i.e., counterclockwise about the Z axis.

Pitch and yaw rotations are achieved as indicated in FIGS. 6 and 7 respectively. In FIG. 6, activation of nozzles 21, 22, 33 and 34 will result in the indicated pitch down clockwise rotation (as viewed in the +X direction) about axis 36 that is parallel to the X axis and passes through the center points of side faces 17 and 19. Activation of nozzles 23, 24, 31 and 32 will result in an opposite counterclockwise pitch motion in which the projectile rotates in the opposite direction about axis 36. FIG. 7 illustrates that activation of nozzles 21, 23, 32 and 34 results in a yaw rotation in which the projectile rotates clockwise (as viewed along the +Y direction) about axis 38 that is parallel to the Y axis and that passes through the midpoints of side faces 16 and 18. Similarly, activation of nozzles 22, 24, 31 and 33 will result in an opposite yaw rotation in which the projectile rotates counterclockwise about axis 38.

Other arrangements of the eight nozzles shown in FIGS. 3–7 are possible and are within the broad scope of the present invention. In particular, so long as two nozzles from each group are capable of producing a reaction force in each direction along each of the X and Y axes, the maneuverability illustrated by FIGS. 2–7 may be achieved. However, a principal constraint in the design of a guided projectile is the ability of the projectile to make high acceleration lateral maneuvers in order to home in on a moving target. The ability to make high acceleration lateral maneuvers is in turn a function of the efficiency of the propulsion system and, in particular, the degree to which inert mass required only for the propulsion system can be minimized. As illustrated below, the nozzle arrangement illustrated in FIGS. 3–7 possesses the major advantage that such a nozzle arrangement may be integrated into the body of the projectile to produce a propulsion system that requires very little mass over and above the mass of the other required components.

Typically, the nonpropulsive payload of a projectile is characterized by an invariant mass $m_l$ that is not a function of the propulsion system design. Given this fact, the mass of a rocket propelled projectile is found from:

$$m_o = \frac{m_l}{1 - \xi/\lambda'} \tag{1}$$

where:

$$\xi = 1 - e^{-V/(g \cdot I_{sp})} = \frac{m_p}{m_o} \tag{2}$$

and $$\lambda' = \frac{m_p}{m_p + m_i} \tag{3}$$

such that $m_o$ is equal to $m_l + m_p + m_i$, and the variables are defined as follows:

V—total propulsive velocity increment (meters/-second)

g—terrestial gravitation constant (9.80665 meters/-second$^2$)

$I_{sp}$—propellant specific impulse (seconds)

$m_p$ mass of expendable propellants (kilograms)

$m_i$—mass of propulsion system inert components (kilograms)

Of these five parameters, V is a constraint defined by the mission requirements, g is a physical constant, and $I_{sp}$ is determined primarily by the choice of propellant. Of the remaining two parameters, $m_p$ is implicitly determined by the parameters $m_l$, V and $I_{sp}$, and $m_i$ is determined by the ratio λ'. Therefore, for a given payload, a stipulated velocity requirement determined by mission details, and a given choice of propellant, the major determinant of total projectile weight is λ', a parameter descriptive of the efficiency of the propulsion system. Values of λ' should be as close to a unity as possible for highest efficiency, i.e., $m_i$ should be as small as possible.

Figure 8:
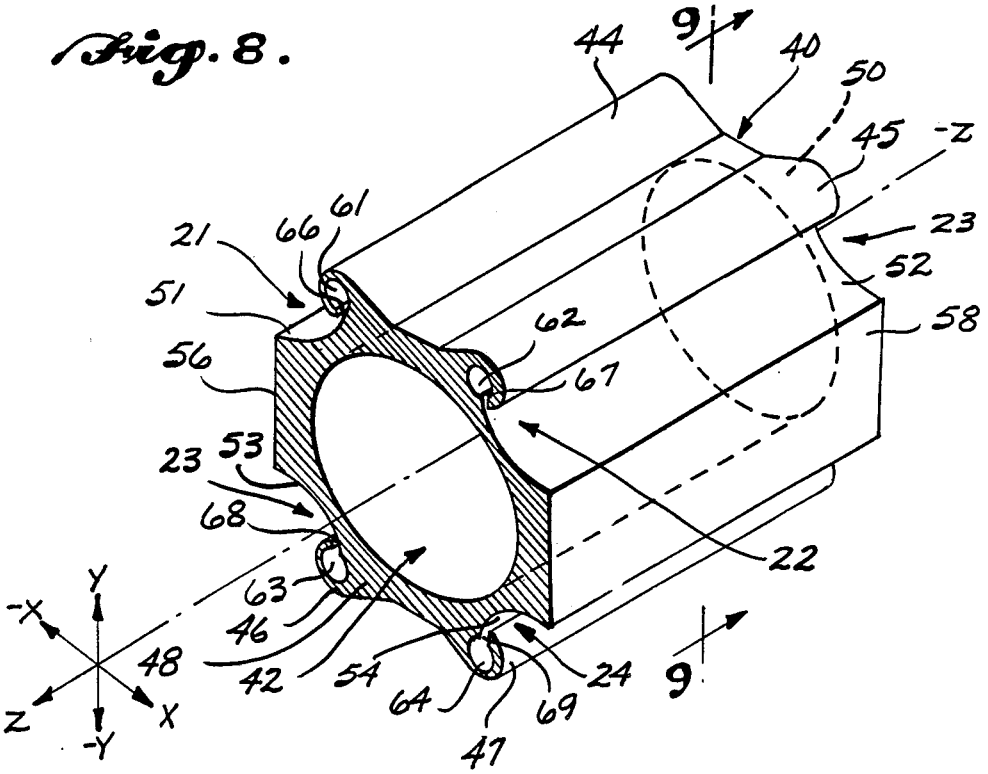
FIG. 8 is a perspective view of a projectile body shaped to form eight linearly extending expansion nozzles.
Figure 9:
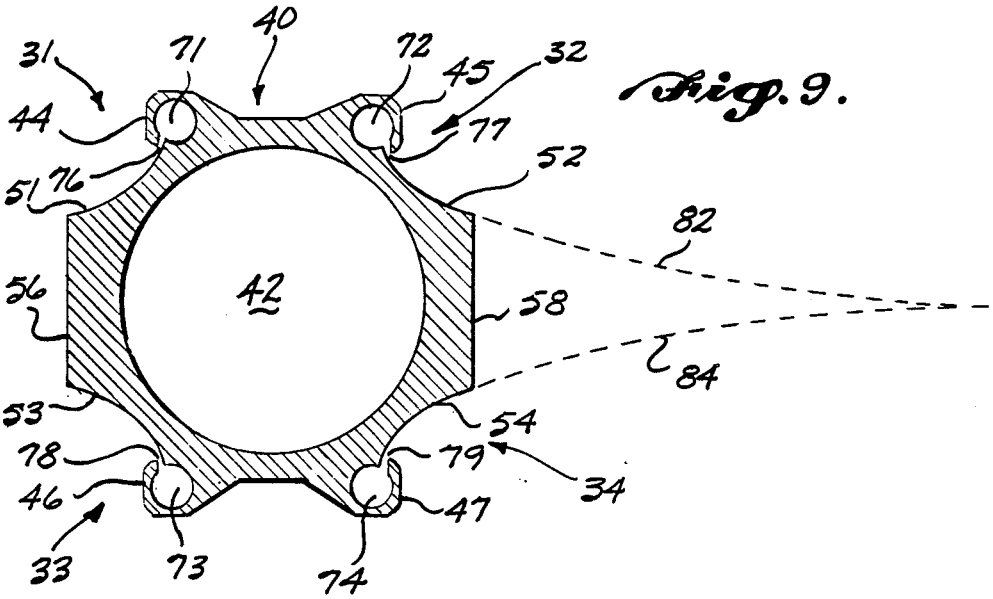
FIG. 9 is a cross-sectional view taken along line 9—9 of FIG. 8.

FIGS. 8 and 9 illustrate a projectile that has the nozzle arrangement shown in FIGS. 1 and 3–7, and in which the mass of the propulsion system inert components $m_i$ is very low. The projectile includes body 40 that includes longitudinally extending central passage 42, and shells 44–47 symmetrically positioned about central passage 42. The central passage and each shell extends from end 48 to opposite end 50 of the body. The left-hand side of body 40 includes reaction surface 51 adjacent to shell 44, reaction surface 53 adjacent to shell 46, and side surface 56 extending between reaction surfaces 51 and 53. Similarly, the right-hand side of body 40 includes reaction surface 52 adjacent to shell 45, reaction surface 54 adjacent shell 47, and side surface 58 extending between reaction surfaces 52 and 54. Each of shells 44–47 forms a generally cylindrical, longitudinally extending opening between itself and the adjacent portion of body 40, which opening is divided halfway along its length by a flow divider (not shown), such that the shell in conjunction with its associated flow divider forms a pair of cylindrical reaction chambers positioned end to end. The eight reaction chambers thus formed by shells 44–47 and the flow dividers are illustrated by reference numerals 61–64 and 71–74 in FIGS. 8 and 9, it being understood that the cross section of FIG. 9 is taken nearer to end 50 than to end 48.

The shells are constructed such that the distal edge of each shell approaches but does not connect with the adjacent portion of body 40, to thereby form a throat through which gas can escape from the reaction chambers formed by the shell and react against the adjacent reaction surface. In particular, gas can escape from reaction chambers 61 and 71 through throats 66 and 76 respectively to react against reaction surface 51; gas can escape from reaction chambers 62 and 72 through throats 67 and 77 respectively to react against reaction surface 52; gas can escape from reaction chambers 63 and 73 through throats 68 and 78 respectively to react against reaction surface 53; and gas can escape from reaction chambers 64 and 74 through throats 69 and 79 respectively to react against reaction surface 54.

Referring now in particular to FIG. 9, when gas under pressure is injected into reaction chamber 72, the gas escapes from the reaction chamber through throat 77 in an initially downward direction. As the gas passes through throat 77, it encounters reaction surface 52 that contours in a downward and outward (rightward) direction. The gas therefore reacts against reaction surface 52 in such a manner as to create a downward and inward reaction force on body 40. The combination of reaction chamber 72, throat 77 and reaction surface 52 thus corresponds to nozzle 32 shown in FIG. 1. As will be appreciated by further comparison of FIGS. 8 and 9 with FIG. 1, each combination of reaction chamber, throat and reaction surface corresponds to and forms one of the eight nozzles 21–24 and 31–34. In an actual embodiment based upon body 40 of FIGS. 8 and 9, the flow dividers separating each pair of end-to-end reaction chambers would be extended outside the respective throats onto the adjacent contoured surface to provide a barrier separating the reaction surfaces of adjacent nozzles. Similar barriers would also be provided adjacent ends 48 and 50 to prevent gas escaping from the nozzles from expanding along the Z axis.

Each of the nozzles formed as indicated in FIGS. 8–9 is a supersonic nozzle adapted to function in a vacuum, i.e., the nozzles do not depend on the Coanda effect, on boundary layer control, or related techniques for developing the required thrust. In a preferred embodiment, each nozzle comprises a two dimensional, linearly extending Prandtl-Meyer expansion nozzle that is truncated at a selected position along its length. The truncation is indicated in FIG. 9, wherein dashed lines 82 and 84 represent the untruncated nozzle contours. The expansion process in a Prandtl-Meyer nozzle originates at the outer corners of the throat, and the flow coming from the throat isentropically expands by turning supersonic around the throat corner. The expansion process is essentially complete within a short distance of the throat, thus permitting the truncation illustrated in FIG. 9 to be made with only a slight loss in performance, but with a large reduction in structural mass. In FIGS. 8 and 9, each pair of nozzles 21 and 23, 22 and 24, 31 and 33, and 32 and 34 may be viewed as a linearly elongated and truncated plug nozzle. However, it will be appreciated that in the arrangement shown in FIGS. 8 and 9, each half of each plug nozzle pair can be operated independently of the other half of that plug nozzle pair, thereby providing the thrust control illustrated in FIGS. 2–7.

Figure 11:
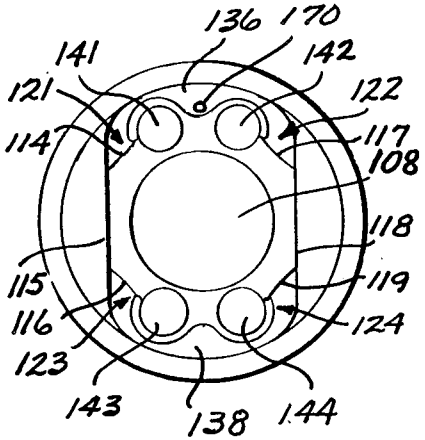
FIG. 11 is a cross-sectional view taken along line 11—11 of FIG. 10; and, FIG. 12 is a top plan view of the projectile of FIG. 10.
Figure 10:
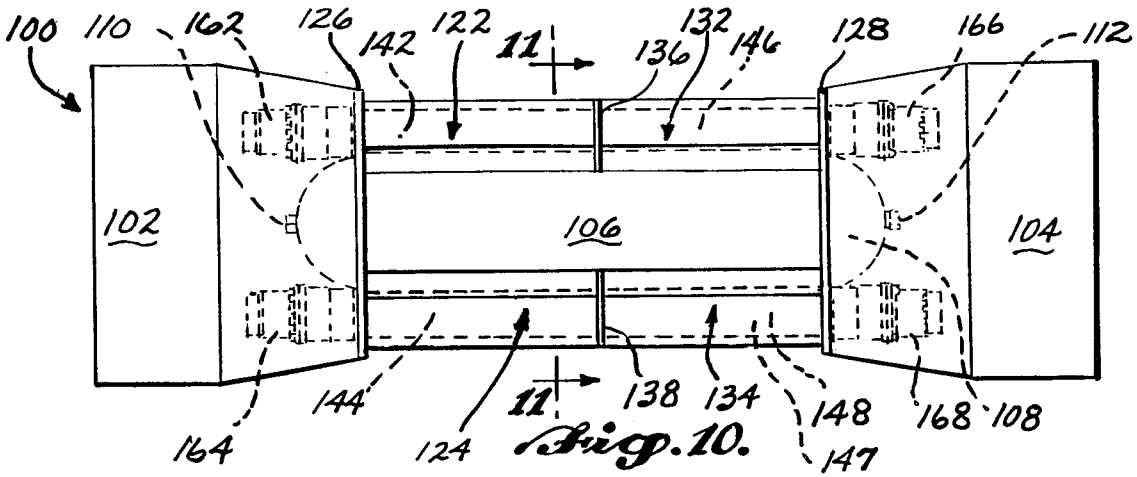
FIG. 10 is a side elevational view of one preferred embodiment of the projectile of the present invention.
Figure 12:
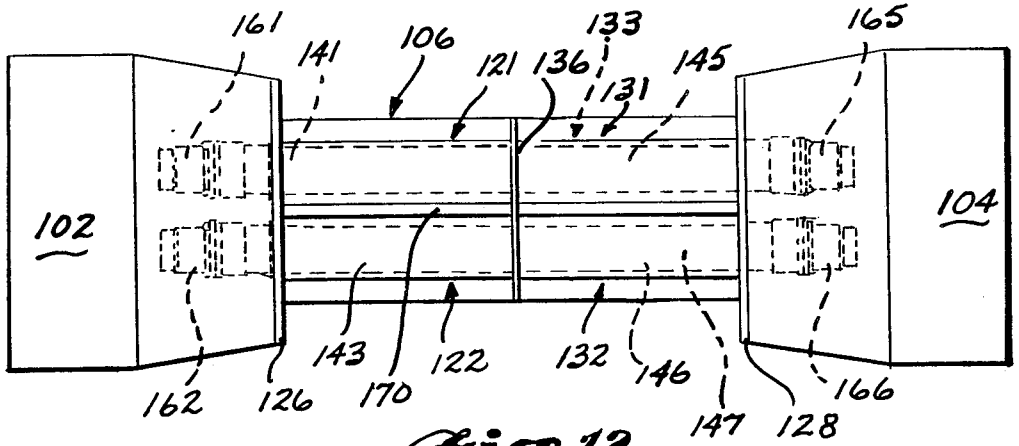

An implementation of the projectile shown in FIGS. 8–9 is illustrated in FIGS. 10–12 for a liquid fuel, monopropellant propulsion system. FIGS. 10–12 show projectile 100 that includes end sections 102 and 104 and central body 106 that extends between and interconnects the end sections. End sections 102 and 104 contain means for tracking a target and for controlling the nozzles such that the projectile is steered toward the target. Such systems are known in the art and will vary depending on the requirements of a particular mission. Central body 106 is similar to body 40 of FIGS. 8 and 9. One side of central body 106 is shaped so as to form reaction surfaces 114 and 116 interconnected by side surface 115, and the other side of the central body is shaped so as to form reaction surfaces 117 and 119 interconnected by side surface 118. The central body includes a longitudinally extending central opening that contains propellant tank 108. The propellant tank extends for the full length of central body 106 and projects somewhat into end sections 102 and 104. Propellant tank 108 includes an internal bladder (not shown) containing a liquid propellant. Outlet 110 at one end of the propellant tank is provided to permit the propellant to flow from the propellant tank, and gas fill valve 112 is provided at the other end of the propellant tank to permit the introduction of a gas (e.g., nitrogen) under pressure to provide the force required to expel the propellant from the propellant tank through outlet 110. It will be appreciated that the construction of central body 106 of projectile 100 provides a large, contiguous central opening in which the propellant tank or other components can be positioned with mininum excess mass and surface area, thereby reducing the mass and improving the maneuverability of the projectile.

Central body 106 of projectile 100 includes eight nozzles consisting of a first group of nozzles 121–124 and a second group of nozzles 131–134, these nozzles corresponding to nozzles 21–24 and 31–34 respectively shown in FIGS. 1 and 3–9. As in the schematic embodiment shown in FIGS. 8 and 9, each nozzle comprises a reaction chamber, an adjacent reaction surface, and a throat through which gas can escape from the reaction chamber to expand and react against the reaction surface. In particular, central body 106 contains four longitudinal passages symmetrically spaced around propellant tank 108, the passages being divided by flow dividers 136 and 138 to form eight reaction chambers 141–148. The flow dividers extend outside the reaction chambers and form boundaries that prevent the gas flowing from a particular nozzle from expanding inward in a lateral direction. Lateral outward expansion of gas from the nozzles is constrained by end plates 126 and 128 positioned at opposite ends of central body 106. Reaction chamber 147 is hidden directly behind reaction chamber 148 in FIG. 10 and directly behind reaction chamber 146 in FIG. 12. Each reaction chamber is interconnected to the adjacent reaction surface by a throat similar to the throat shown in FIGS. 8 and 9.

Catalyst beds 161–168 are positioned in communication with the outermost ends of reaction chambers 141–148 respectively. Propellant is caused to selectively flow from outlet 110 of propellant tank 108 to the catalyst beds, wherein the propellant is decomposed by the catalyst to form hot gaseous products which then flow into the associated reaction chamber and out through the throat to react against the reaction surface, thereby providing thrust. Outlet 110 may be connected to catalyst beds 161–164 by suitable conduits and valves (not shown). The propellant may be routed to catalyst beds 165–168 by means of feed line 170 that extends between end sections 102 and 104.

It will be appreciated by reference to FIG. 1 that the first and second groups of nozzles need not be contiguous with one another, but instead can be spaced apart from one another along the Z axis. For example, in the embodiment shown in FIGS. 10–12, the area occupied by flow dividers 136 and 138 could be expanded into a longitudinally extended central area of the projectile, so long as flow dividers were provided at the longitudinally inner boundaries of the now separated nozzles. Such an arrangement, wherein the nozzle groups were separated along the Z axis, would, in general, increase the efficiency of pitch and yaw rotational movements of the projectile.

While the preferred embodiments of the invention have been illustrated and described, it should be understood that variations will be apparent to those skilled in the art. Accordingly, the invention is not to be limited to the specific embodiments illustrated and described, and the true scope and spirit of the invention are to be determined by the following claims.

The embodiments of the invention in which an exclusive property privilege is claimed are defined as follows:

1. A projectile having an integrated propulsion system, the projectile comprising a body in which eight supersonic nozzles are positioned, the nozzles being arranged such that each nozzle can provide a reaction force having nonzero components along both a first axis and a second axis, the first and second axes being fixed with respect to the body and orthogonal to one another, the nozzles comprising first and second groups of four nozzles each, the first and second groups being spaced from one another along a third axis orthogonal to the first and second axes, and the nozzles in each group being arranged such that for each direction along each of the first and second axes, two nozzles of the group can each produce a reaction force having a nonzero component along that direction.

2. The projectile of claim 1, wherein for each group, the nozzles are positioned at the four corners of a rectangle, such that two sides of the rectangle are parallel to the first axis and the other two sides of the rectangle are parallel to the second axis.

3. The projectile of claim 2, wherein the two directions along which each nozzle can produce a reaction force along the first and second axes are directed respectively toward two other nozzles of the same group.

4. The projectile of claim 3, wherein each nozzle includes a throat through which gas can escape in an initial flow direction that is principally inward along the second axis, and a reaction surface having a contour that extends from adjacent the throat inward along the second axis and outward along the first axis.

5. The projectile of claim 4, wherein each nozzle is linearly elongated along the third axis.

6. The projectile of claim 5, wherein each nozzle comprises a Prandtl-Meyer expansion nozzle.

7. The projectile of claim 2, wherein the body has the form of a tube, each nozzle being positioned at the outer surface of the tube, each nozzle comprising a reaction chamber, a reaction surface, and a throat through which gas can escape from the reaction chamber to react against the reaction surface.

8. The projectile of claim 7, wherein each nozzle comprises a cylindrical shell extending from the tube and having a distal end that approaches but that does not contact the tube, to thereby form the reaction chamber within the shell and the throat between the distal end of the shell and the tube.

9. The projectile of claim 8, wherein each nozzle is linearly elongated along the third axis.

10. The projectile of claim 9, wherein within each group of nozzles, each nozzle has an identical extent along the third axis.

11. The projectile of claim 10, whereby each reaction surface extends from its associated throat in an outward direction along the first axis and in an inward direction along the second axis.

12. The projectile of claim 11, wherein each reaction surface is contoured to form a Prandtl-Meyer expansion nozzle.

13. The projectile of claim 12, wherein each Prandtl-Meyer expansion contour is truncated.

* * * * *